US010557688B2

(12) United States Patent
Batenhorst et al.

(10) Patent No.: US 10,557,688 B2
(45) Date of Patent: Feb. 11, 2020

(54) ACCESSORY MOUNTING ASSEMBLY FOR A FIREARM

(71) Applicant: LA POLICE GEAR, INC., Valencia, CA (US)

(72) Inventors: Ryan Batenhorst, Valencia, CA (US); Mark Hedman, Valencia, CA (US)

(73) Assignee: LA POLICE GEAR, INC., Valencia, CA (US)

( * ) Notice: Subject to any disclaimer, the term of this patent is extended or adjusted under 35 U.S.C. 154(b) by 0 days.

(21) Appl. No.: 16/258,433

(22) Filed: Jan. 25, 2019

(65) Prior Publication Data

US 2019/0234710 A1 Aug. 1, 2019

Related U.S. Application Data

(60) Provisional application No. 62/622,817, filed on Jan. 26, 2018.

(51) Int. Cl.
*F41G 11/00* (2006.01)

(52) U.S. Cl.
CPC ..... *F41G 11/004* (2013.01)

(58) Field of Classification Search
CPC ..... F41G 11/004; F41G 11/003
USPC ..... 42/124, 125, 127, 146
See application file for complete search history.

(56) References Cited

U.S. PATENT DOCUMENTS

| | | | | |
|---|---|---|---|---|
| 6,874,269 | B2 * | 4/2005 | Chen | F41G 11/003 42/106 |
| 10,030,939 | B2 * | 7/2018 | Kowalczyk, Jr. | F41G 1/35 |
| 2014/0190063 | A1 * | 7/2014 | Lau | F41G 11/003 42/146 |
| 2017/0138701 | A1 * | 5/2017 | Kowalczyk, Jr. | F41G 11/003 |
| 2018/0087757 | A1 * | 3/2018 | Mock | F21V 23/003 |
| 2019/0301835 | A1 * | 10/2019 | Tayon | F41G 1/35 |

* cited by examiner

*Primary Examiner* — Reginald S Tillman, Jr.
(74) *Attorney, Agent, or Firm* — Loza & Loza, LLP; Heidi L. Eisenhut

(57) ABSTRACT

A mounting assembly for securing an auxiliary device to a firearm is provided. The mounting assembly allows a variety of different sizes of auxiliary devices to be adjustably mounted to a firearm. The mounting assembly may be secured to mounting rails located on opposing sides of the bottom of a barrel of a firearm.

20 Claims, 10 Drawing Sheets

ACCESSORY MOUNTING ASSEMBLY FOR A FIREARM

FIELD

This present disclosure relates to a mounting assembly for attaching an accessory or auxiliary device to a firearm and more specifically to providing a mounting system that provides the flexibility and the adjustability to mount the accessory or auxiliary device on any type of and size of firearm, such as any type of gun, allowing the user to position to the accessory or auxiliary device where needed for the user.

BACKGROUND

To prevent that accidental shooting of a person or object instead of an intended target, the shooter needs to be able to effectively see the target and aim the firearm in the direction of the target. It is well known to use accessories or auxiliary devices to illuminate the target to properly aim the weapon, especially at night and any other low light conditions such as in unlit structures. One popular accessory for mounting to weapons it a tactical illuminator or light.

Mounting or securing an auxiliary device to a firearm generally requires separate brackets or other mechanical components, which may necessitate various types of tools, such as screwdrivers and wrenches for example. Additionally, each firearm is different and requires a custom auxiliary device that will specifically fit to the unique mounting system of the firearm. An individual may have several firearms and need a separate auxiliary device for each firearm. Having a unique auxiliary device for each firearm also requires the user to be familiar with how each mounting system functions and to carry the proper tools to be able to mount the appropriate auxiliary device to the corresponding firearm.

In view of the above, what is needed is a single (or one size fits all) mounting system that provides the flexibility and adjustability to be used to mount or secure an accessory to any type of firearm instead of requiring a unique mounting system for each particular type of firearm.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature a mounting system for securing an auxiliary device to a weapon is provided. The mounting system comprises a housing having a distal end, an opposing proximal end and a longitudinally extending housing groove extending within an upper surface of the housing; a first mounting assembly detachably secured to a first side of the housing; a second mounting assembly fixedly secured to a second side of the housing, the upper surface located between the first and second sides of the housing and where the first mounting assembly moveable in relation to the second mounting assembly; and a tab slidably located between the first and second mounting assemblies and within the longitudinally extending housing groove, where the slideable tab is configured to adjust placement of the auxiliary device adapting the auxiliary device to the weapon.

According to one aspect, the mounting system further comprises an actuator rotatably secured to, and extending outwardly from, the proximal end of the housing where the actuator includes a pair of extending arm members that are integrally connected.

According to another aspect, the auxiliary device is a tactical illuminator which emits from the distal end of the housing and the actuator on the proximal end of the housing controls activation of the light.

According to yet another aspect, the first mounting assembly comprises a first back member; an upper ledge extending outwardly from the back member; a lower edge, separated from and located below the upper ledge; a first mounting assembly groove formed by the separation of the upper ledge and the lower edge, the first mounting assembly groove adapted to receive a portion of the auxiliary device securing the auxiliary device to the mounting system.

According to yet another aspect, the first mounting assembly further comprises a first receiving post integrally connected to, and located below the lower edge; a second receiving post integrally connected to, and located below the lower edge; and a main receiving post integrally connected to, and located below, the lower edge and between the first and second receiving posts.

According to yet another aspect, the second mounting assembly comprises a second back member; an upper portion extends outwardly from the second back member; a second mounting assembly groove located below the upper portion adapted to receive a second portion of the auxiliary device securing the auxiliary device to the mounting system; and a lower portion extends downward and outwardly from the second mounting assembly groove.

According to yet another aspect, the second back member of the second mounting assembly comprises a main hole adapted for receiving a first threaded bolt, the first threaded bolt extends through the main hole and into the longitudinally extending housing groove; and a second hole adapted for receiving a second threaded bolt, the first threaded bolt extends through the second hole and into the longitudinally extending housing groove.

According to yet another aspect, the first threaded bolt further extends through a third hole located in the housing and into the main receiving post of the first mounting assembly; wherein the first threaded bolt is adapted for adjusting the first mounting assembly to accommodate the auxiliary device to different weapons; and wherein the first threaded bolt engages with the tab.

According to yet another aspect, the second back member of the second mounting assembly comprises: a main hole adapted for receiving a first threaded bolt, the first threaded bolt extends through the main hole and into the longitudinally extending housing groove; and a second hole adapted for receiving a second threaded bolt, the first threaded bolt extends through the second hole and into the longitudinally extending housing groove; and wherein the tab further comprises: a pair of opposing vertical sides integrally connected to a vertical back wall and a vertical front wall, the sides and walls are located between a bottom of the upper surface member and a top of the lower surface member; and one or more holes located in one vertical side of the pair of vertical sides adapted to receive the second threaded bolt and wherein the second threaded bolt has a conical end.

According to yet another aspect, the tab comprises a horizontally elongated member having an upper surface and an opposing lower surface; an upper surface member extending upwardly from a partial upper surface portion of the elongated member; and a lower surface member extending downwardly from a partial portion lower surface.

According to yet another aspect, a width of the partial upper surface portion of the horizontally elongated member is the same width of the upper surface member of the horizontally elongated member.

According to yet another aspect, a width of the partial lower surface portion horizontally elongated member is larger than the width of the lower surface member of the horizontally elongated member.

According to yet another aspect, a horizontally elongated member creates an undercut allowing the tab to slide in the longitudinally extending housing groove.

According to yet another aspect. a height of the partial upper surface portion of the horizontally elongated member is larger than a height of the partial lower surface portion of the horizontally elongated member.

According to yet another aspect, the auxiliary device is part a utility handle for a weapon or a scope ring for a weapon.

According to another feature, a mounting system for securing an auxiliary device to a weapon is provided. The mounting system includes a housing having a distal end, an opposing proximal end and a longitudinally extending housing groove extending within an upper surface of the housing; and a first mounting assembly detachably secured to a first side of the housing. The first mounting assembly comprises a first back member; an upper ledge extending outwardly from the back member; a lower edge, separated from and located below the upper ledge; and a first mounting assembly groove formed by the separation of the upper ledge and the lower edge, the first mounting assembly groove adapted to receive a first portion of the auxiliary device securing the auxiliary device to the mounting system.

The mounting system further comprises a second mounting assembly fixedly secured to a second side of the housing, the upper surface located between the first and second sides of the housing and where the first mounting assembly moveable in relation to the second mounting assembly; a tab slidably located between the first and second mounting assemblies and within the longitudinally extending housing groove, where the slideable tab is configured to adjust placement of the auxiliary device adapting the auxiliary device to the weapon.

According to an aspect, the first mounting assembly further comprises a first receiving post integrally connected to, and located below, the lower edge; a second receiving post integrally connected to, and located below the lower edge; and a main receiving post integrally connected to, and located below, the lower edge and between the first and second receiving posts.

According to another aspect, the second mounting assembly comprises a second back member; an upper portion extends outwardly from the second back member; a second mounting assembly groove located below the upper portion adapted to receive a second portion of the auxiliary device securing the auxiliary device to the mounting system; and a lower portion extends downward and outwardly from the second mounting assembly groove.

According to yet another aspect, the second back member of the second mounting assembly comprises a main hole adapted for receiving a first threaded bolt, the first threaded bolt extends through the main hole and into the longitudinally extending housing groove; and a second hole adapted for receiving a second threaded bolt, the first threaded bolt extends through the second hole and into the longitudinally extending housing groove.

According to yet another aspect, the first threaded bolt further extends through a third hole located in the housing and into the main receiving post of the first mounting assembly; wherein the first threaded bolt is adapted for adjusting the first mounting assembly to accommodate the auxiliary device to different weapons; and wherein the first threaded bolt engages with the tab.

According to yet another aspect, the tab comprises a horizontally elongated member having an upper surface and an opposing lower surface; an upper surface member extending upwardly from a partial upper surface portion of the elongated member; and a lower surface member extending downwardly from a partial portion lower surface.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

Figure 1:
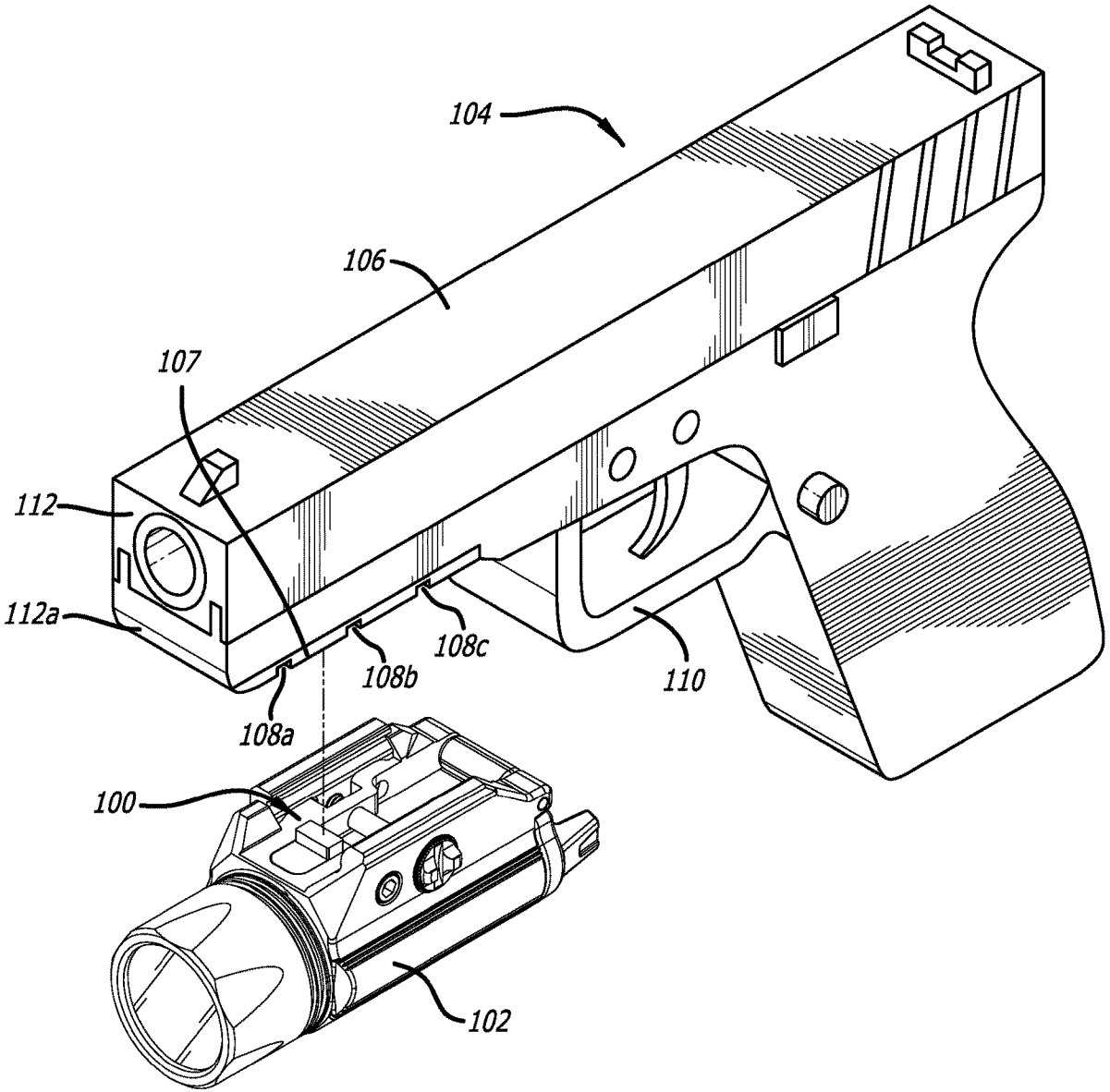
FIG. 1 is a perspective view of a mounting system on a tactical illuminator for mounting onto a firearm, according to an aspect of the present disclosure.

The present disclosure will now be described in detail with reference to the accompanying drawings. In the following description, numerous specific details are set forth in order to provide a thorough understanding of the aspects described herein. It will be apparent, however, to one skilled in the art, that these and other aspects may be practiced without some or all of these specific details. In other instances, well known process steps and/or structures have not been described in detail in order to not unnecessarily obscure the description.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise. The word "exemplary" is used herein to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage, or mode of operation.

The term "mounting system" may refer to, but is not limited to, a system that is used to mount an accessory to a weapon. The term "firearm" may refer to, but is not limited to a pistol, handgun, shotgun, revolver, rifle, magnum, automatic, semiautomatic or any other type of a firearm incorporating a metal tube from which bullets, shells, or other missiles are propelled by explosive force, typically making a characteristic loud, sharp noise. The term "accessory" or "auxiliary device" may refer to, but is not limited to, scopes, illuminators, lasers, aiming lights and combined illuminator/laser units. The term "mount" may refer to, but is not limited to secure, affix install, place, position, fit and put on. The term "rails" may refer to small strips of metal or polymer put on or removed from any given surface on a gun to allow attachment of some sort of accessory.

Overview

The present disclosure is directed to a mounting system used for mounting an auxiliary device to a firearm. While the present disclosure is described primarily with respect to a mounting system for mounting a light or tactical illuminator to a firearm, the mounting system of the present disclosure may be applied and adapted mounting various other types of auxiliary devices or accessories to various types of firearms. Also, a variety of other embodiments are contemplated having different combinations of the below described features of the mounting system of the present disclosure, having features other than those described herein, or even lacking one or more of those features. As such, it is understood that the mounting system can be carried out in various other suitable modes.

For convenience and ease of understanding, the present disclosure will be described primarily with respect to the auxiliary device as a tactical illuminator or light that can be mounted to a firearm for generally casting light unto a target, target area or a portion of the target area.

Mounting Assembly

Figure 2:
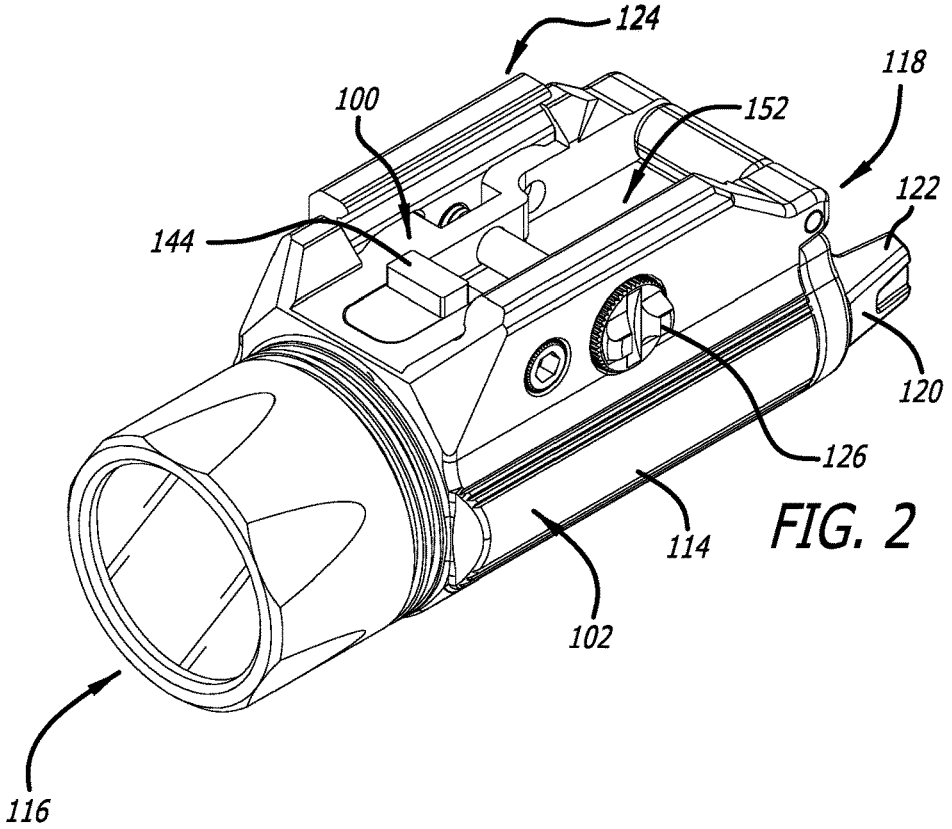
FIG. 2 is a top perspective view of the mounting system of the present disclosure shown on the tactical illuminator of FIG. 1.
Figure 3:
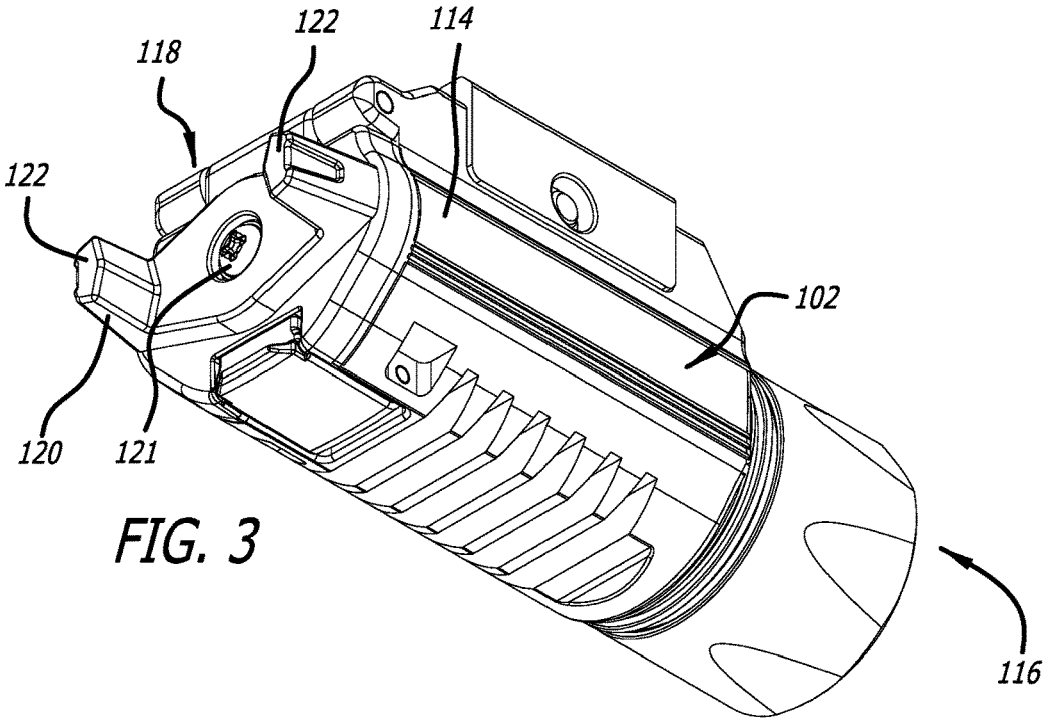
FIG. 3 is a bottom perspective view of the tactical illuminator of FIG. 1.
Figure 4:
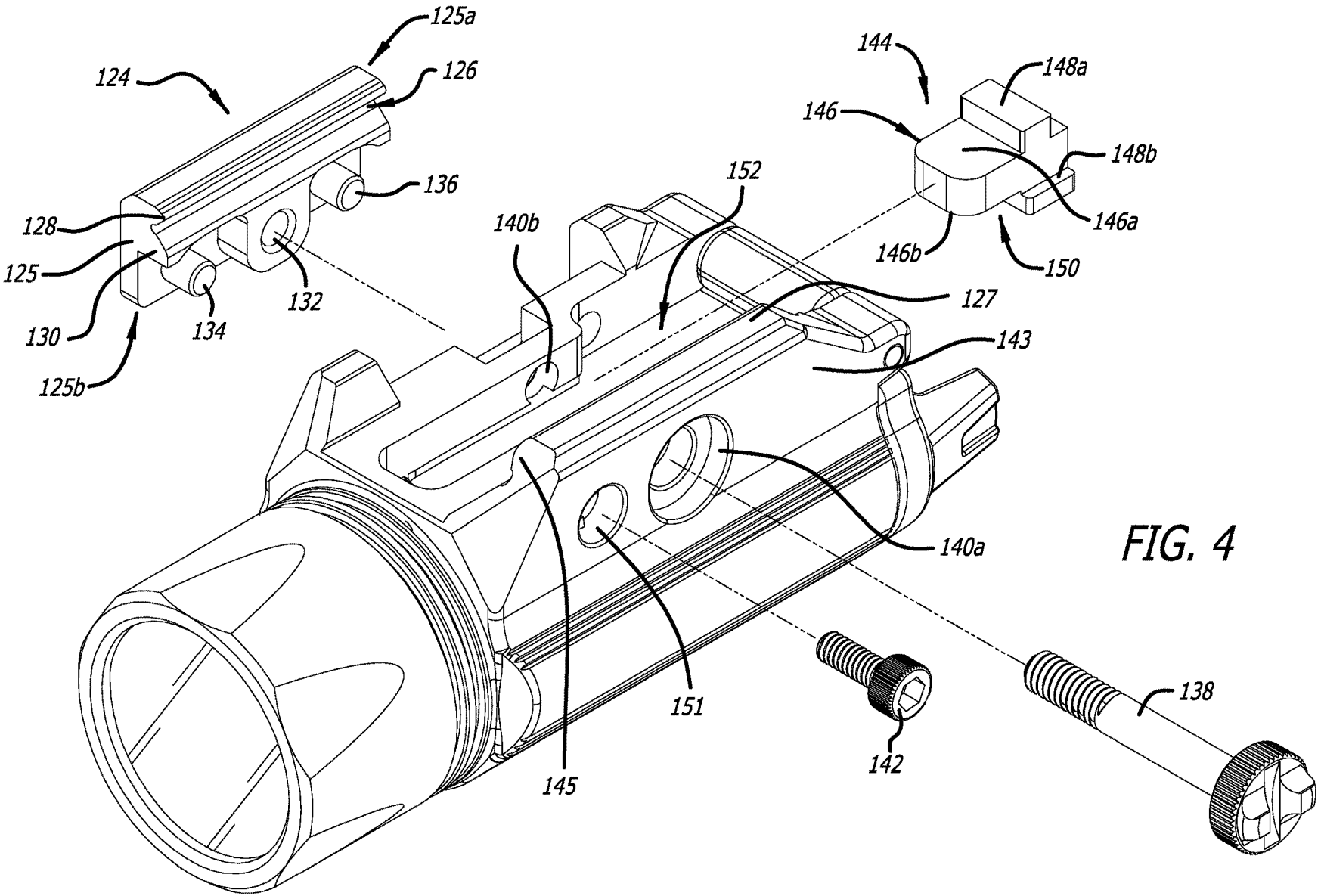
FIG. 4 is an exploded view of the mounting system of the tactical illuminator of FIG. 1 according to one example.

FIG. 1 is a perspective view of a mounting system 100 on an auxiliary device 102 aligned with grooves on the underside of the barrel of a firearm 104. FIG. 2 is a top perspective view of the mounting system of the present disclosure shown on the tactical illuminator of FIG. 1. FIG. 3 is a bottom perspective view of the tactical illuminator of FIG. 1. FIG. 4 is an exploded view of the mounting system on the tactical illuminator of FIG. 1.

According to one embodiment, the firearm 104 may comprise a frame 106 with rails, grooves or locking spots 108, located in and extending along at least a portion of the frame 106, and adapted to be received by the mounting system 100 of the tactical illuminator 102 as described in detail below.

According to one example, the firearm 104 may include rails 107 located on a surface of the firearm, such as the underside 112*a* of the barrel of the firearm 104 and include a plurality of grooves or locking spots which may be adapted to receive the mounting system 100 of the present disclosure, as described in more detail below. As shown, the rails 107 may include three (3) grooves or locking spots 108*a*-108*c* and extend from the trigger guard 110 to the foreword most end of the underside 112*a* of the barrel 112 of the firearm 104. Although three locking spots 108*a*, 108*b*, 108*c* are shown, this is by way of example only and the firearm 104 may have more than three locking spots or less than three locking spots. The locking spots may be located in and extending along at least a portion of the frame 106 of the firearm 104 and may preferably be parallel with the horizontal axis of the barrel 112.

As shown, the mounting system 100 of the tactical illuminator 102 may be aligned directly one or more of the locking spots 108*a*-108*c* on the rails 107 of the firearm. The plurality of locking spots allow the user to select the most suitable location for mounting of the tactical illuminator 102.

With reference to FIG. 4, there is depicted the tactical illuminator 102 showing an exploded view of a mounting system securing the tactical illuminator 102 to a firearm.

As described above, the tactical illuminator 102 is an auxiliary device for a firearm that may be used to cast light upon a target, target area and/or a portion thereof. The target area may be a large area and function as a flashlight, for example, or the target area may be a small concentrated area and function as a laser pointer, for example. FIGS. 2 and 3 illustrate a top and bottom perspective views of the tactical illuminator 102 utilizing the mounting system 100 of the present disclosure. The tactical illuminator 102 is shown for purpose of example only and other tactical illuminators or auxiliary devices may be utilized with the mounting system 100 of the present disclosure.

The tactical illuminator 102 as shown may include a housing 114 having a distal end 116 from which light is emitted and an opposing proximal end 118 which controls the activation of the light. As shown in FIG. 3, the proximal end 118 includes an actuator 120 rotatably secured to, and extending outwardly from, the proximal end 118 by a screw 121 allowing a user to press or rotate the actuator 120 for activating and deactivating the light. In one example, the actuator 120 may include two extending arm members 122 that are integrally connected such that both extending arms 122 move together and not independently of each other. A user may rotate, press or push the actuator 120 in a clockwise or counterclockwise direction about a longitudinal axis of the tactical illuminator for activating and deactivating the light.

Although a single actuator is shown, it is well within the scope of the present disclosure more than one actuator may be used. For example, tactical illuminator may include a first actuator spaced apart from a second actuator. In such an example, the first actuator may operate independently of the second actuator and the user may activate and deactivate the light using one or both of the first and second actuators.

An exploded view of the mounting system 100 of the present disclosure on the tactical illustrator 102 is shown. The mounting system 100 may include a tab or sliding assembly 144 located between a first mounting assembly 124 and a second mounting assembly 127 that is configured to lock the tactical illuminator (or other auxiliary device) in place when in an assembled configuration. The tab or sliding assembly 144 is able to slide between the first and second mounting assemblies 124, 127 allowing for the auxiliary device to be adapted to the firearm as opposed to having to utilize an auxiliary device specifically designed for the exact type of fire arm being used. The first mounting assembly 124 may slide horizontally away from, or horizontally toward the second mounting assembly 127 for adapting to the size of a particular auxiliary unit.

Figure 8:
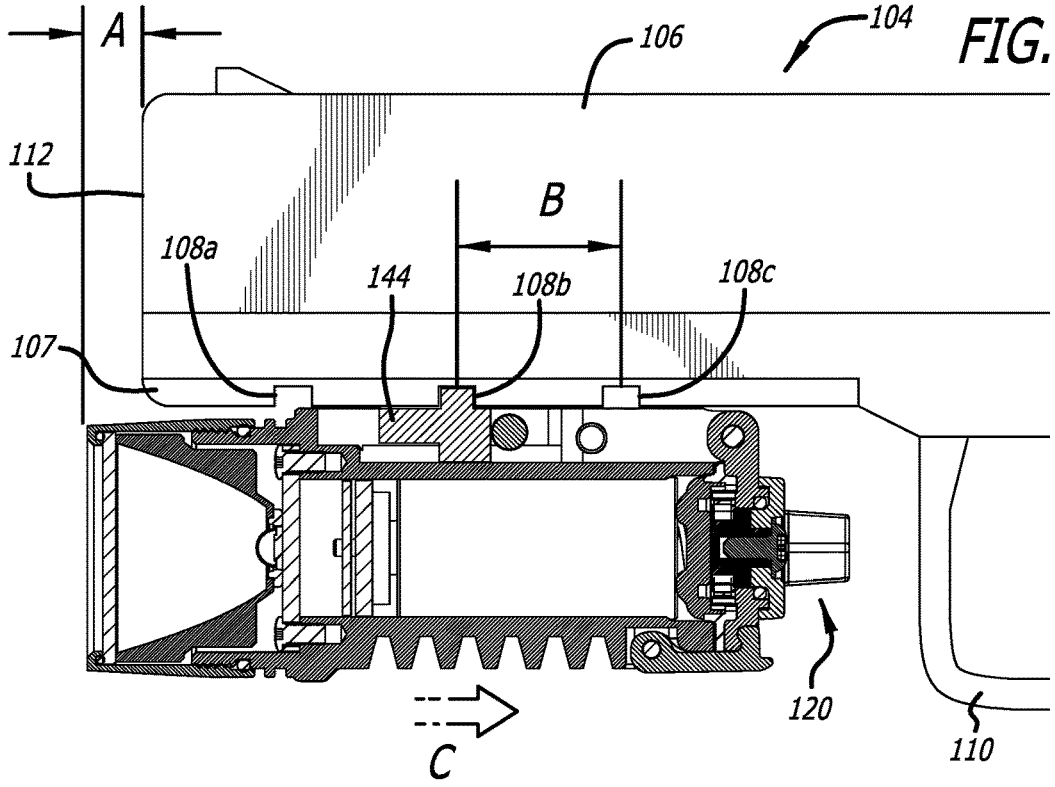
FIG. 8 is a cross-sectional view of a tactical illuminator secured to rails on the barrel of a firearm and extending past the end of the barrel.

When in an assembled configuration, the mounting system 100 locks the auxiliary device onto the firearm. FIG. 8 illustrates a cross-sectional view of a tactical illuminator secured to rails on the barrel of the firearm. When installing the tactical illuminator onto the barrel of the firearm, the first and second mounting assemblies 124, 127 are mounted onto opposing rails on the underside of the barrel of the gun and the tab or sliding assembly 144 allows the mounting assembly to be adjusted for the specific tactical light being utilized. In a typical situation unlike the present disclosure, a tactical illuminator would be mounted onto the barrel of the gun and the tab in the prior art is locked into place, i.e. is not moveable and does not slide. As a result of conventional systems in which the tab is locked in place, the tactical illuminator extends past the end of the barrel by a dimension "A" which is undesirable as gun powder and residue, for example, extrudes out the end of the barrel and onto the tactical illuminator extending past the end of the barrel of the gun as well as on the end of the barrel of the gun. If gun power and residue were covering the end of the barrel and/or the tactical illuminator, the firearm may not fire property and may not fit in a holster properly as the gun powder and other residue would come into contact with the bottom of the holster before the firearm. As such, the firearm would not be secured properly within the holster.

Figure 9:
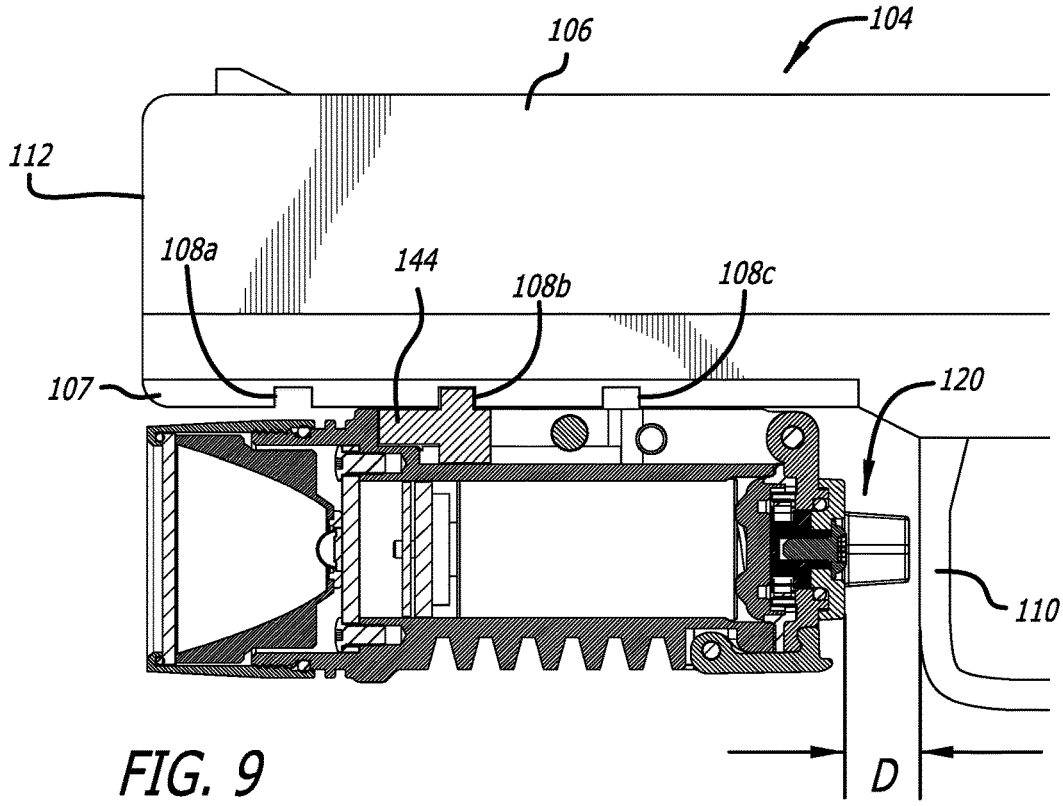
FIG. 9 is a cross-sectional view of the tactical illuminator of FIG. 8 showing the slide tab of the present disclosure used to adjust the location of the tactical illuminator.

The present disclosure overcomes this problem in the prior art by allowed the tab or sliding assembly 144 of the mounting assembly 100 to slide within the mounting system 100 allowing the user to adjust the tactical illuminator to its proper position. If a user wants to slide the tactical illuminator in the direction "C", the user may utilize the tab or sliding assembly 144 in the mounting assembly 100 to slide the tactical illuminator in the direction "C" such that the end of the tactical illuminator is flush with the end of the barrel of the firearm (See FIG. 9) and no longer extends past the end of the barrel of the firearm by the distance "A" (See FIG. 8). Dimension "B" in FIG. 8 illustrates the width of the rails on the firearm so the user desires to slide this width "B" back in the direction of "C". In conventional systems, putting the tab in the back one (i.e. groove of rail) the right side of dimension "B" would result in the tactical illuminator hitting the trigger guard on the right. So by just being able to slide the tab or sliding assembly 144 as in the present disclosure and not in the prior art system, the user can slide the tab back the distance "D" to avoid hitting the trigger guard and also cause the tactical illuminator to be flush with the barrel of the firearm.

In other words, the present disclosure allows the user to mount the tactical illuminator on the firearm and move the sliding tab or sliding assembly 144 into a center locking spot (i.e. where the left side of the dimension "B" so that tactical illuminator is in the proper location. The problem with the prior art is that the tactical illuminator cannot be moved as the prior art does not teach, disclose or suggest a moveable tab, only a tab piece that is fixed (i.e. non-moveable) and cannot slide back and forth like the present disclosure.

The tab or sliding assembly 144 may secure the mounting system 100 to the rails on the firearm. As shown in FIG. 1, the tactical illuminator 102 may be mounted and secured to mounting rails, such as a mounting rail 107 of the firearm 104, the first mounting assembly 124. The first mounting assembly 124 may include a back member 125, an upper ledge or surface 128 and a lower ledge of surface 130 separated by a first mounting assembly groove 126. The first mounting assembly groove 126 may be formed by the separation between of the upper ledge 128 and the lower edge 130. The upper ledge 128 and the lower edge 130 are integrally connected to extend outwardly from the back member 125 and are located in separate parallel horizontal planes and where the back member 125 is located in vertical place. According to one example, the upper ledge 128 and the lower edge 130 extend perpendicularly outward from the back member 125. The first mounting assembly groove 126 may be configured for, or adapted to, receive a portion of the auxiliary device (such as a tactical illuminator) securing the auxiliary device to the mounting system. As shown, first mounting assembly 124 may include a main threaded receiving post 132 for receiving a first threaded bolt 138. Receiving posts 134 and 136 are located on either side of the main threaded received post 132 and configured for receiving threaded bolts.

Figure 10:
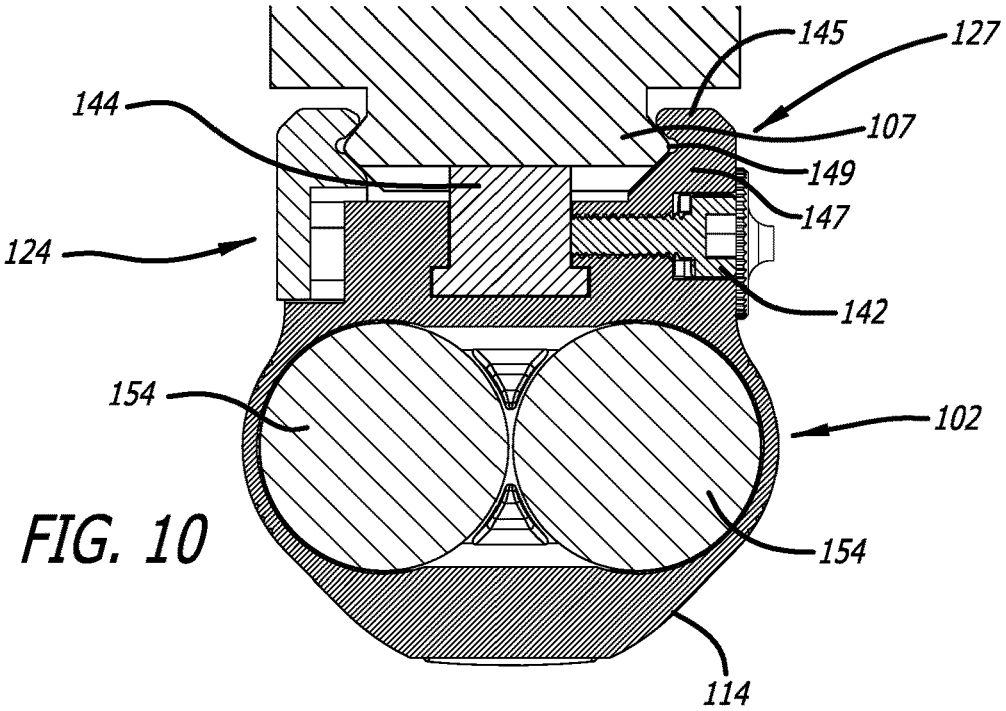
FIG. 10 is a cross-sectional view taken along line 10-10 of FIG. 5.
Figure 11:
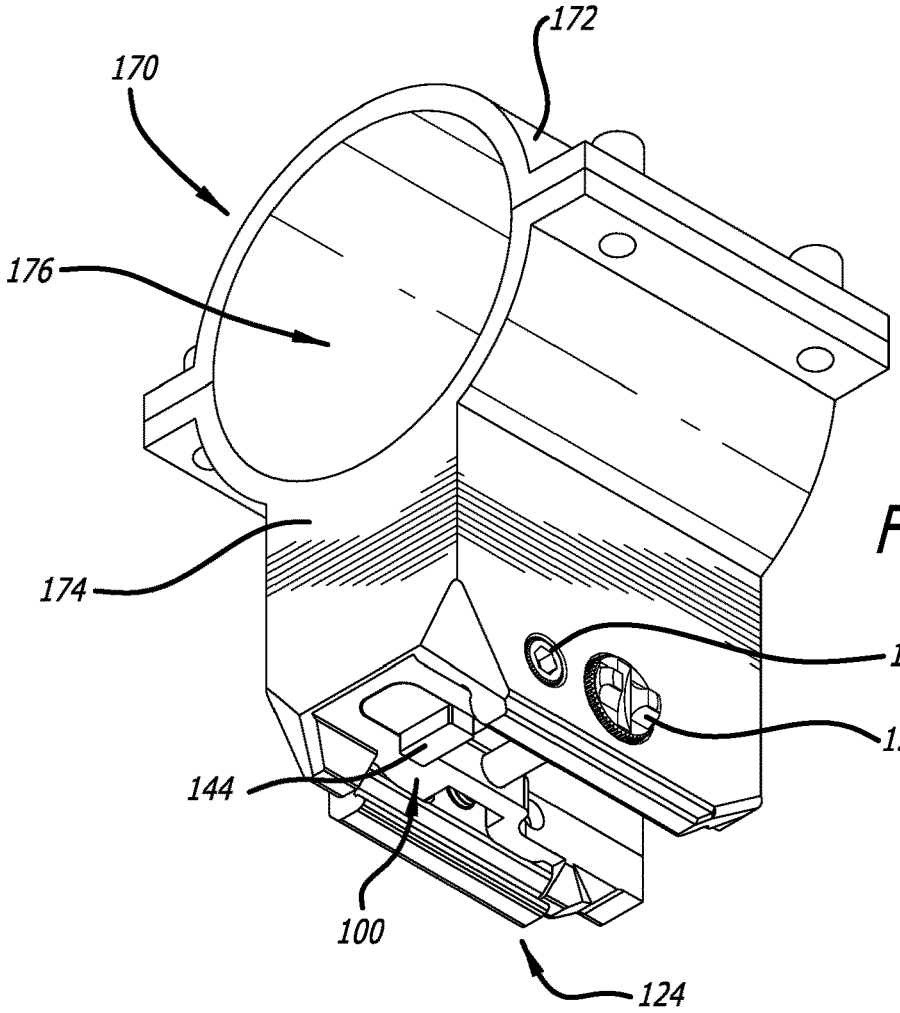
FIG. 11 illustrates the mounting system of the present disclosure on a scope ring.
Figure 12:
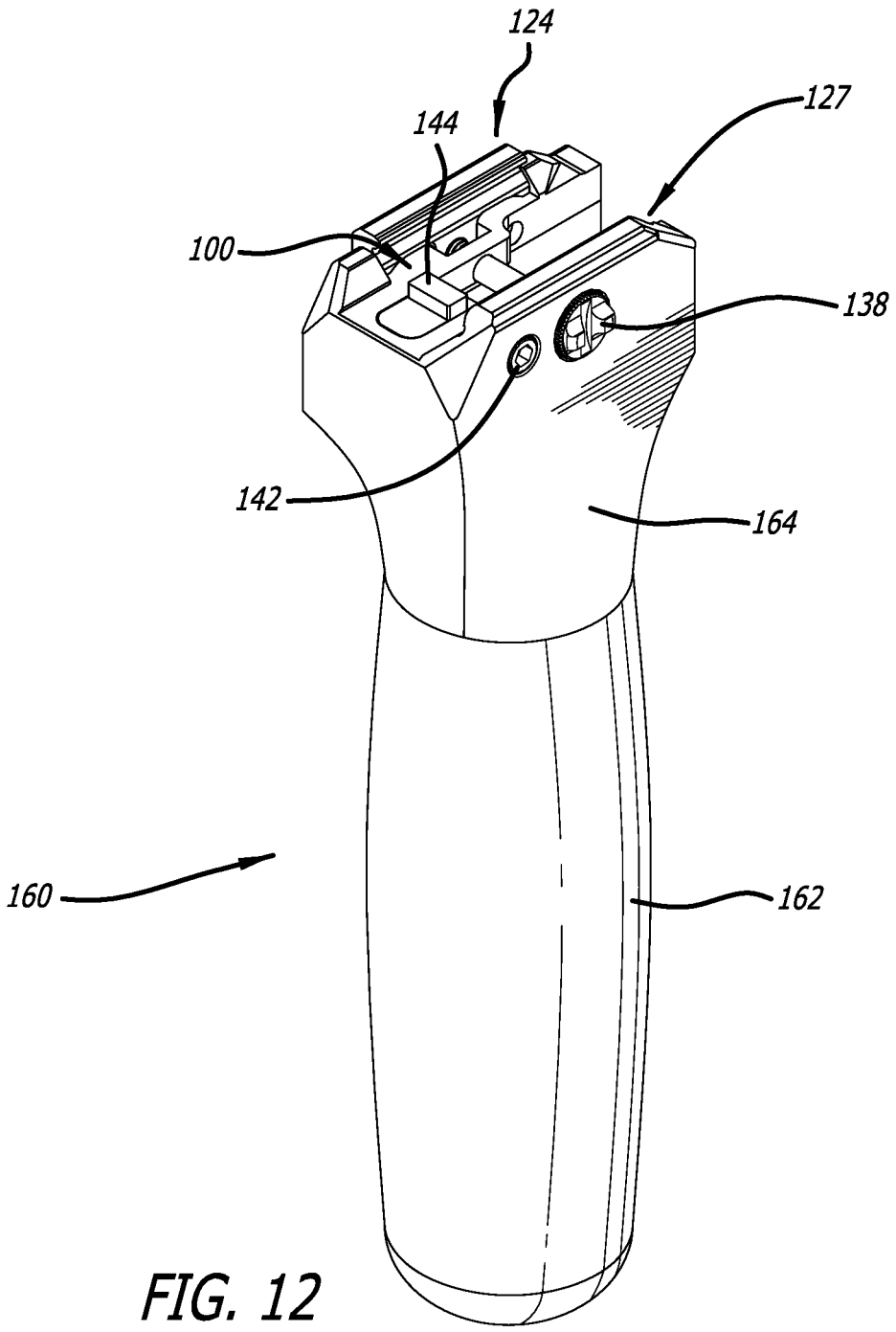
FIG. 12 illustrates the mounting system of the present disclosure on a utility handle.
Figure 13:
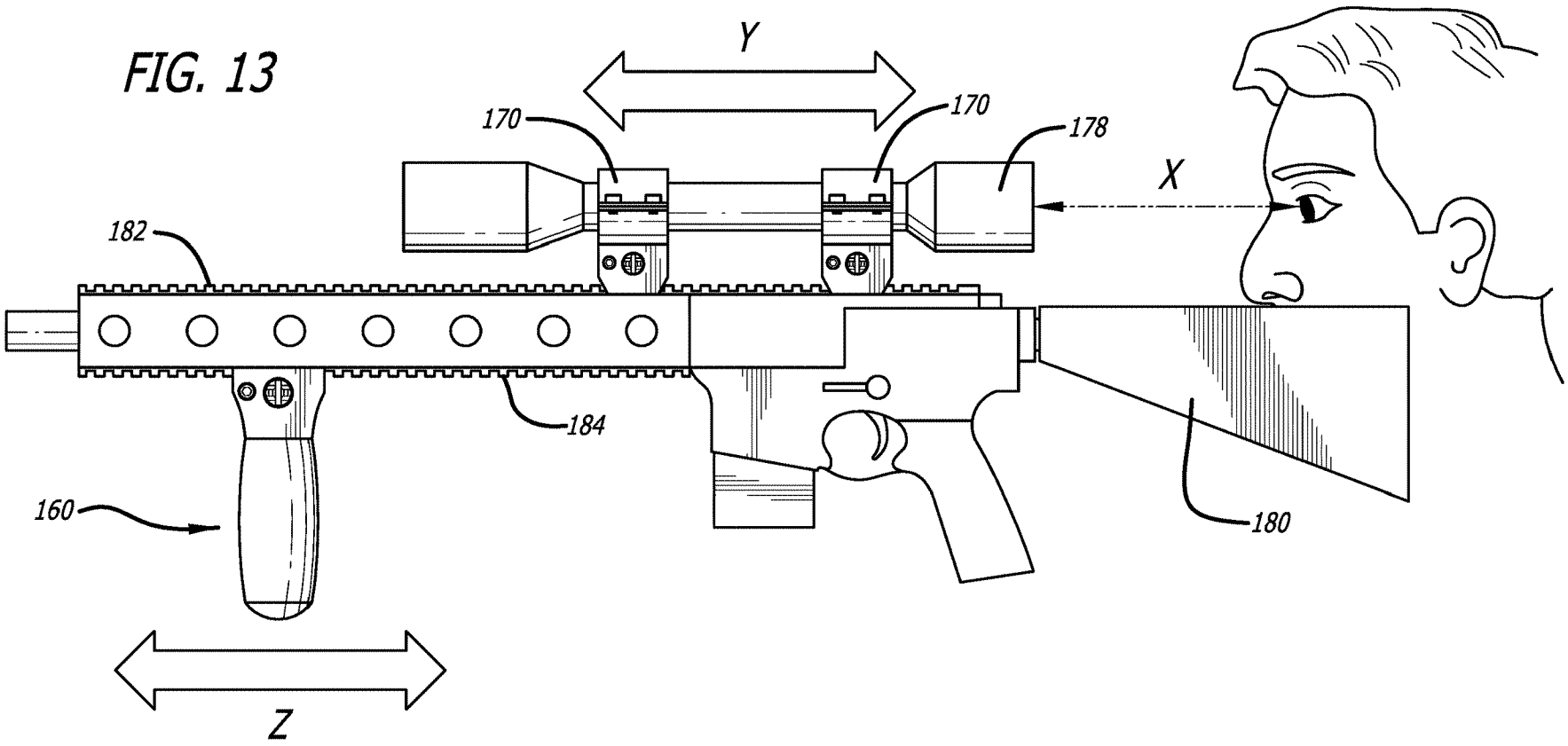
FIG. 13 illustrates the utility handle of FIG. 13 mounted on the bottom rack of a rifle.

The second mounting assembly 126, fixedly attached to the auxiliary device, may include a second back member 143, an upper portion 145, a lower portion 147 and a second mounting assembly groove 149. As shown in FIG. 10, the second mounting assembly groove 149 is located below the upper portion 145 and the lower portion 147. The upper portion 145 may extend outwardly from the second back member and the lower portion 147 extends downward and outwardly from the second mounting assembly groove 149. The second mounting assembly groove 149 may be configured for, or adapted to, receive a portion of the auxiliary device (such as a tactical illuminator) securing the auxiliary device to the mounting system. As shown in FIG. 4, the back member 143 of the second mounting assembly 127 may include a main hole 140*a* for receiving the first threaded bolt 138 and a second hole 151 for receiving a second threaded bolt 142. The first threaded bolt 138 may extend through the main hole 140*a*, the longitudinally extending housing groove 152, a third hole 140*b* in the mounting system and the hole located in the main threaded receiving post 132.

The second threaded bolt 142 extends through the hole 151 in the side of the tactical illuminator into the longitudinally extending housing groove 152. The second threaded bolt 142 allows a user to adjust the location of the tab or sliding assembly 144 to the auxiliary device can be adjusted to fit the particular weapon.

The first mounting assembly 124 secured to the tactical illuminator by a threaded clamp screw disposed through a first hole in the body of the tactical light and into a threaded hole in the mounting assembly 124.

As shown in FIG. 4, the mounting system 100 may further include the tab or sliding assembly 144 having a horizontally elongated member 146 having an upper surface 146*a* and an opposing lower surface 146*b*. The tab or sliding assembly 144 further includes an upper surface member 148*a* extending upwardly from a partial upper surface portion 146*a* of the elongated member 146 and a lower surface member 148*b* extending downwardly from a partial portion lower surface 146. According to one example, the width of the partial upper surface portion 146*a* may have the same width of the upper surface member 146. According to one example, the width of the partial lower surface portion 146*b* is larger than the width of the lower surface member 148*b* of the horizontally elongated member 146. The larger width of the lower surface member 148*b* creates an undercut 150, the undercut 150 allows the tab 144 to slide in the longitudinally extending housing groove 152 of the tactical illuminator maintaining the tactical illuminator in the mounting system 100. According to one aspect, the height of the partial upper surface portion 146*a* of the horizontally elongated member 146 is larger than the height of the lower surface member 148*b* of the horizontally elongated member 146.

Figure 5:
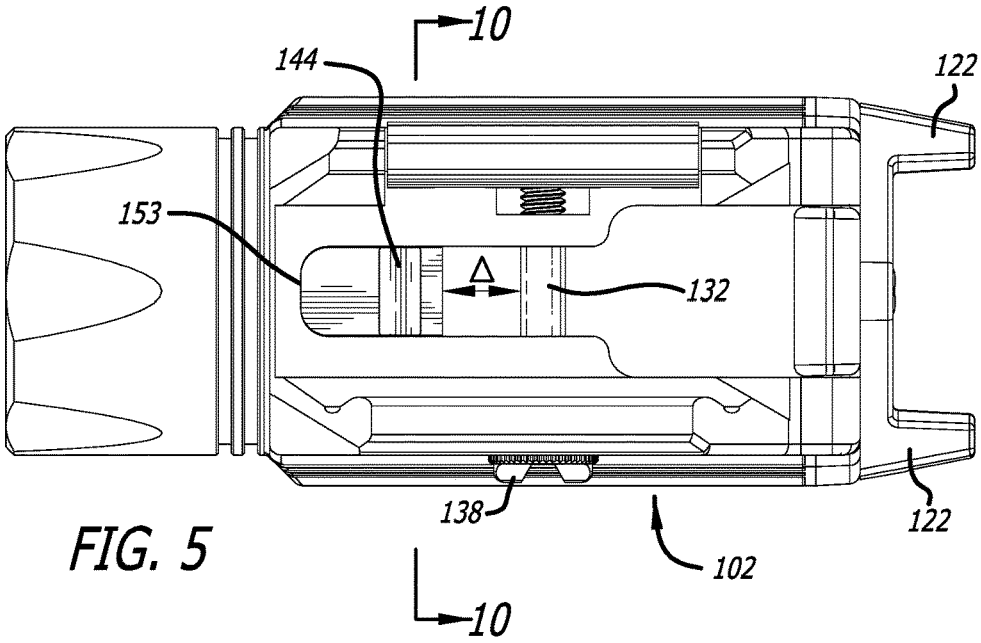
FIG. 5 is a top plan view of the mounting system of the tactical illuminator of FIG. 1.
Figure 6:
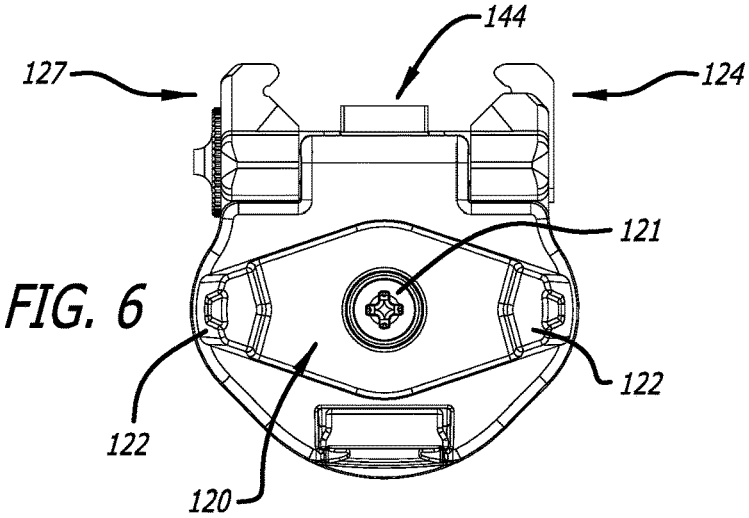
FIG. 6 is a back elevation view of the mounting system of the tactical illuminator of FIG. 1.
Figure 7:
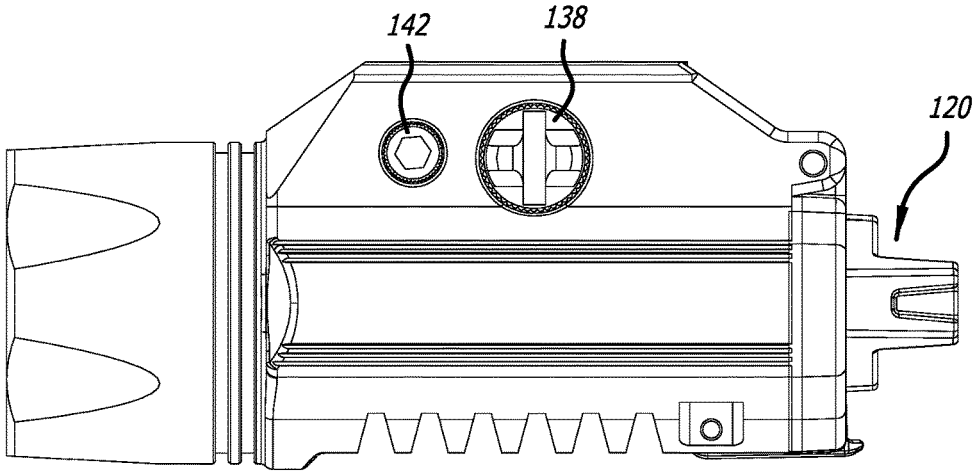
FIG. 7 is a side elevation view of the mounting system of the present disclosure on a tactical illuminator.

In FIG. 5, the dimension A ("delta") may be the distance in which the tab or sliding assembly 144 can slide. Because it can slide from the very front which is right up against the front of the groove that it slides in to the bolt that runs across to the other lock—that is the other bolt that is running across there.

The actuator 120 may be used for controlling operation of the light sources of light.

Tab or Sliding Assembly—Mounting Holes

Figure 14:
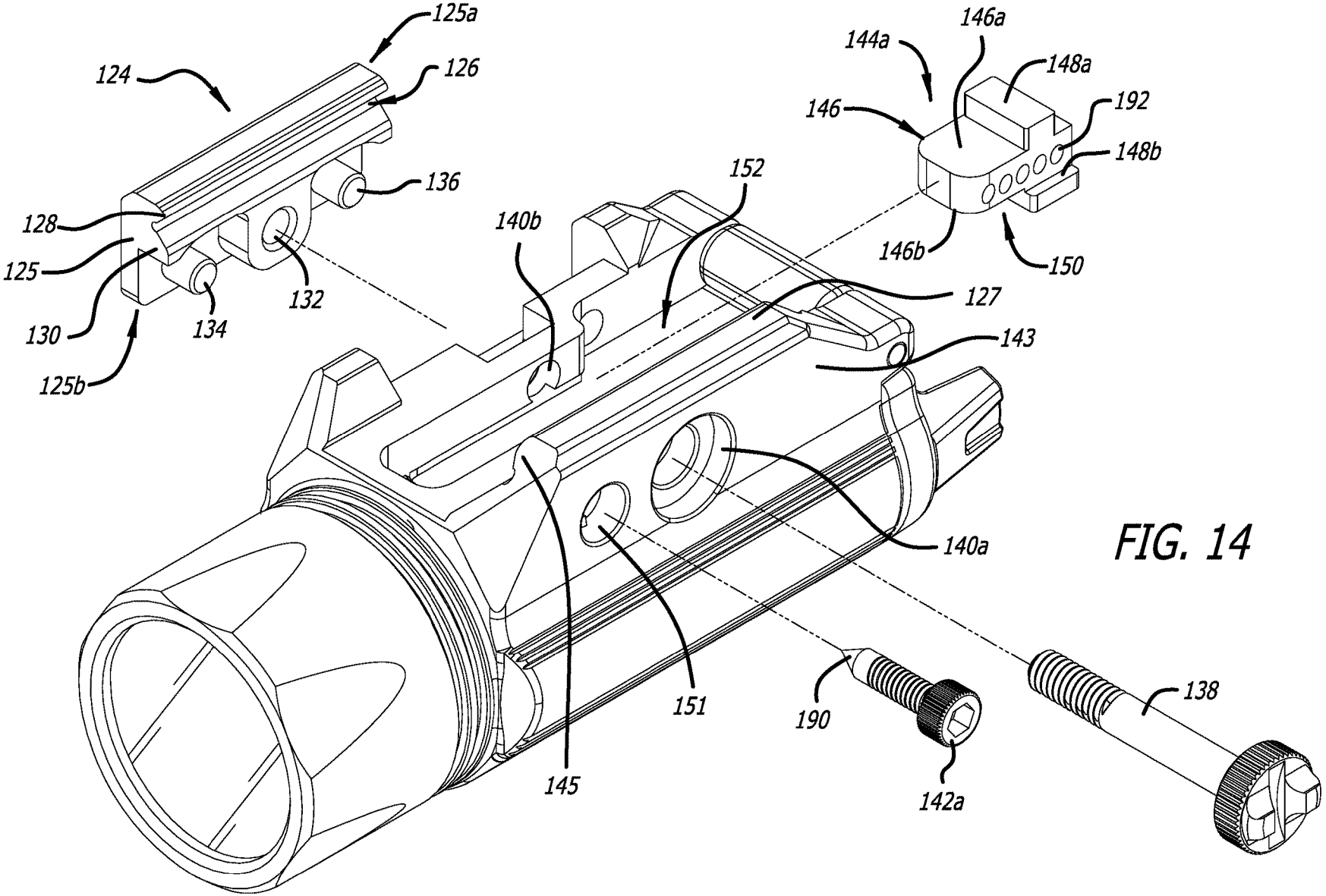
FIG. 14 is an exploded view of the mounting system of the tactical illuminator of FIG. 1 according to a second embodiment.
Figure 15:
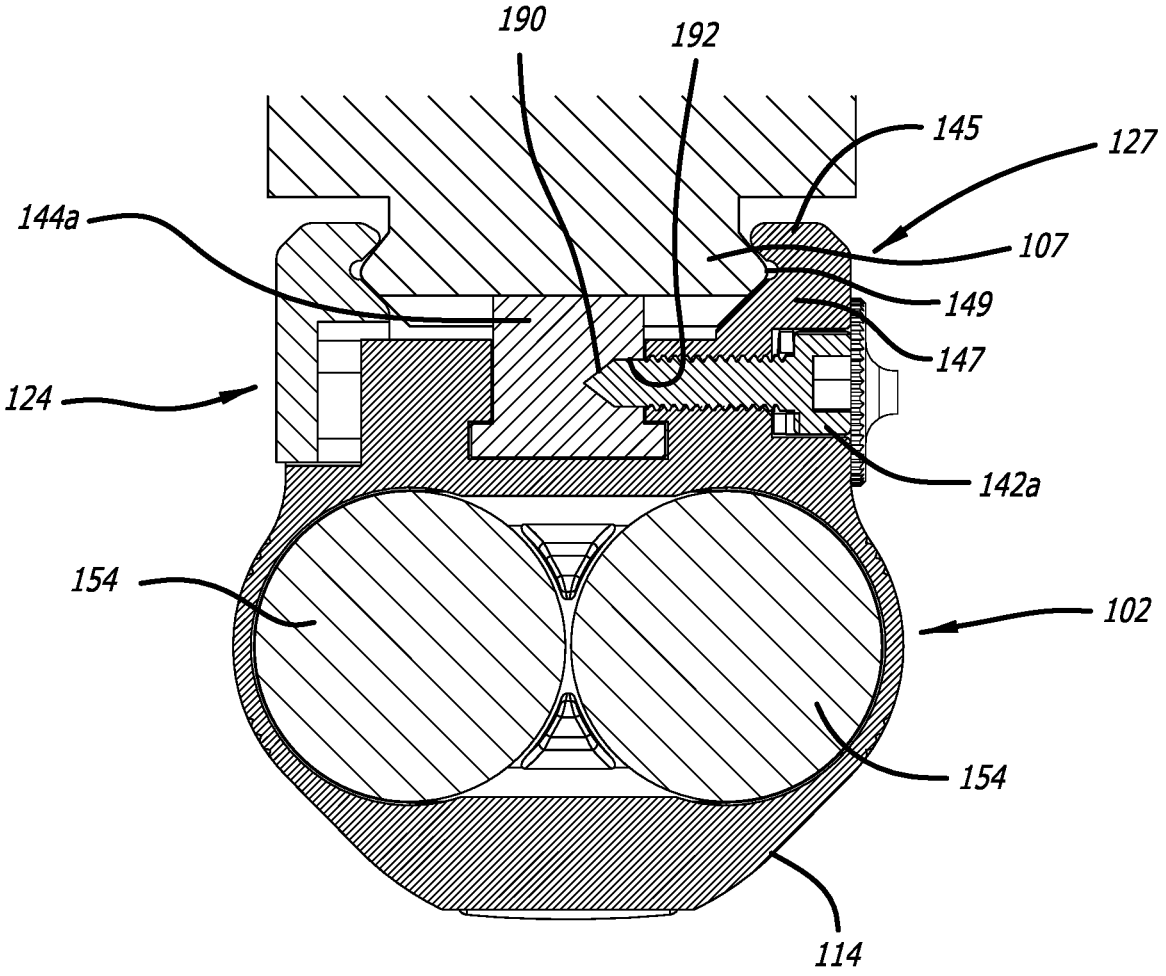
FIG. 15 is a cross-sectional view taken along line 10-10 of FIG. 5 according to the second embodiment.

FIG. 14 is an exploded view of the mounting system of the tactical illuminator of FIG. 1 according to a second embodiment. FIG. 15 is a cross-sectional view taken along line 10-10 of FIG. 5 according to the second embodiment. For clarity and convenience, the features, parts and/or elements described in FIGS. 1-13 that are similarly shown in FIGS. 14-15 correspond to the same reference numbers. Additional or new features, parts and/or elements in FIGS. 14 and 15 are uniquely referenced. To reduce redundancy, not all of the features, parts and/or elements in FIGS. 1-13 are re-described with reference to FIGS. 14 and 15 below.

With reference to FIG. 14, the tactical illuminator 102 is shown having an exploded view of the mounting system securing the tactical illuminator 102 to a firearm with a tab or sliding assembly 144*a* according to a second embodiment. The tab or sliding assembly 144*a* may be adapted to slide between the first and second mounting assemblies 124, 127 allowing for the auxiliary device to be adapted to the firearm as opposed to having to utilize an auxiliary device specifically designed for the exact type of fire arm being used. The first mounting assembly 124 may slide horizontally away from, or horizontally toward the second mounting assembly 127 for adapting to the size of a particular auxiliary unit.

As shown in FIG. 14, the tab or sliding assembly 144*a* of the mounting assembly 100 may include a horizontally elongated member 146 having an upper surface 146*a* and an opposing lower surface 146*b*. The tab or sliding assembly 144*a* may further include an upper surface member 148*a* extending upwardly from a partial upper surface portion 146*a* of the elongated member 146 and a lower surface member 148*b* extending downwardly from a partial portion lower surface 146. The tab or sliding assembly 144*a* additionally includes a pair of opposing vertical sides integrally connected to a vertical back wall and a vertical front wall, all of which are located between a bottom of the upper surface member 148*a* and a top of the lower surface member 148. One of the vertical sides of the tab or sliding assembly 144*a* includes one or more openings or holes 192. Although five (5) holes 192 are shown, the tab or sliding assembly 144*a* may include less than four (4) holes or more than five (5) holes.

According to one example, the width of the partial upper surface portion 146*a* may have the same width of the upper surface member 146. According to one example, the width of the partial lower surface portion 146*b* is larger than the width of the lower surface member 148*b* of the horizontally elongated member 146. The larger width of the lower surface member 148*b* creates an undercut 150, the undercut 150 allows the tab 144*a* to slide in the longitudinally extending housing groove 152 of the tactical illuminator maintaining the tactical illuminator in the mounting system 100. According to one aspect, the height of the partial upper surface portion 146*a* of the horizontally elongated member 146 is larger than the height of the lower surface member 148*b* of the horizontally elongated member 146.

As described previously, the back member 143 of the second mounting assembly 127 may include the main hole 140*a* for receiving the first threaded bolt 138. As shown in FIGS. 14-15, the second hole 151 is adapted for receiving a second threaded bolt 142*a* having a conical nose 192. The user may slide the tab or sliding assembly 144*a* between the first and second mounting assemblies and within the longitudinally extending housing groove 152 into the proper position. Once the tab or sliding assembly 144*a* is in the proper position, the second hole may receive the second threaded bolt 142*a* having the conical nose 192. The conical nose 192 helps or assists to align the screw into one of the holes 192 further securing the tab or sliding assembly 144*a* within the longitudinally extending housing groove 152 and preventing the tab or sliding assembly 144*a* from moving once in position. The different holes 192 along the vertical side allow the user to place the tab or sliding assembly 144*a* into a position that is appropriate for the fire arm that is being used. The second threaded bolt 142*a* extends through the hole 151 in the side of the tactical illuminator into the longitudinally extending housing groove 152. The second threaded bolt 142*a* allows a user to adjust the location of the tab or sliding assembly 144 to the auxiliary device can be adjusted to fit the particular weapon.

Additionally, as described previously, the first threaded bolt 138 may be extended through the main hole 140*a*, the longitudinally extending housing groove 152, a third hole 140*b* in the mounting system and the hole located in the main threaded receiving post 132 further securing the device to the fire arm.

The first mounting assembly 124 may be secured to the tactical illuminator by a threaded clamp screw disposed through a first hole in the body of the tactical illuminator and into a threaded hole in the mounting assembly 124.

The second mounting assembly 126, fixedly attached to the auxiliary device, may include a second back member 143, an upper portion 145, a lower portion 147 and a second mounting assembly groove 149. As shown in FIG. 15, the second mounting assembly groove 149 is located below the upper portion 145 and the lower portion 147. The upper portion 145 may extend outwardly from the second back member and the lower portion 147 extends downward and outwardly from the second mounting assembly groove 149. The second mounting assembly groove 149 may be configured for, or adapted to, receive a portion of the auxiliary device (such as a tactical illuminator) securing the auxiliary device to the mounting system. FIG. 15 also shows the second threaded bolt 142*a* having a conical nose inserted into a hole 192 in the vertical side of the tab or sliding assembly 144*a* providing additional strength and assurance that the tab or sliding assembly 144*a* does not move.

The various features of the disclosure described herein can be implemented in different devices or weapons without departing from the disclosure. It should be noted that the foregoing aspects of the disclosure are merely examples and are not to be construed as limiting the disclosure. The description of the aspects of the present disclosure is intended to be illustrative, and not to limit the scope of the claims. As such, the present teachings can be readily applied to other types of apparatuses and many alternatives, modifications, and variations will be apparent to those skilled in the art.

What is claimed is:

1. A mounting system for securing an auxiliary device to a weapon, comprising:

a housing having a distal end, an opposing proximal end and a longitudinally extending housing groove extending within an upper surface of the housing;

a first mounting assembly detachably secured to a first side of the housing;

a second mounting assembly fixedly secured to a second side of the housing, the upper surface located between the first and second sides of the housing and where the first mounting assembly moveable in relation to the second mounting assembly; and a tab slidably located between the first and second mounting assemblies and within the longitudinally extending housing groove, where the slideable tab is configured to adjust placement of the auxiliary device adapting the auxiliary device to the weapon.

2. The mounting system of claim 1, further comprising:

an actuator rotatably secured to, and extending outwardly from, the proximal end of the housing where the actuator includes a pair of extending arm members that are integrally connected.

3. The mounting system of claim 2, wherein the auxiliary device is a tactical illuminator which emits from the distal end of the housing and the actuator on the proximal end of the housing controls activation of the light.

4. The mounting system of claim 1, wherein the first mounting assembly comprises:

a first back member;

an upper ledge extending outwardly from the back member;

a lower edge, separated from and located below the upper ledge; and a first mounting assembly groove formed by the separation of the upper ledge and the lower edge, the first mounting assembly groove adapted to receive a first portion of the auxiliary device securing the auxiliary device to the mounting system.

5. The mounting system of claim 4, wherein the first mounting assembly further comprises:

a first receiving post integrally connected to, and located below, the lower edge;

a second receiving post integrally connected to, and located below the lower edge; and a main receiving post integrally connected to, and located below, the lower edge and between the first and second receiving posts.

6. The mounting system of claim 5, wherein the second mounting assembly comprises:

a second back member;

an upper portion extends outwardly from the second back member;

a second mounting assembly groove located below the upper portion adapted to receive a second portion of the auxiliary device securing the auxiliary device to the mounting system; and a lower portion extends downward and outwardly from the second mounting assembly groove.

7. The mounting system of claim 6, wherein the second back member of the second mounting assembly comprise:

a main hole adapted for receiving a first threaded bolt, the first threaded bolt extends through the main hole and into the longitudinally extending housing groove; and a second hole adapted for receiving a second threaded bolt, the first threaded bolt extends through the second hole and into the longitudinally extending housing groove.

8. The mounting system of claim 7, wherein the first threaded bolt further extends through a third hole located in the housing and into the main receiving post of the first mounting assembly; wherein the first threaded bolt is adapted for adjusting the first mounting assembly to accommodate the auxiliary device to different weapons; and wherein the first threaded bolt engages with the tab.

9. The mounting assembly of claim 1, wherein the tab comprises:

a horizontally elongated member having an upper surface and an opposing lower surface;

an upper surface member extending upwardly from a partial upper surface portion of the elongated member; and a lower surface member extending downwardly from a partial portion lower surface.

10. The mounting assembly of claim 6, wherein the second back member of the second mounting assembly comprises:

a main hole adapted for receiving a first threaded bolt, the first threaded bolt extends through the main hole and into the longitudinally extending housing groove; and a second hole adapted for receiving a second threaded bolt, the first threaded bolt extends through the second hole and into the longitudinally extending housing groove; and wherein the tab further comprises:

a pair of opposing vertical sides integrally connected to a vertical back wall and a vertical front wall, the sides and walls are located between a bottom of the upper surface member and a top of the lower surface member; and one or more holes located in one vertical side of the pair of vertical sides adapted to receive the second threaded bolt and wherein the second threaded bolt has a conical end.

11. The mounting assembly of claim 9, wherein a width of the partial upper surface portion of the horizontally elongated member is the same width of the upper surface member of the horizontally elongated member.

12. The mounting assembly of claim 9, wherein a width of the partial lower surface portion horizontally elongated member is larger than the width of the lower surface member of the horizontally elongated member; and wherein the larger width of the lower surface member of the horizontally elongated member creates an undercut allowing the tab to slide in the longitudinally extending housing groove.

13. The mounting assembly of claim 9, wherein a height of the partial upper surface portion of the horizontally elongated member is larger than a height of the partial lower surface portion of the horizontally elongated member.

14. The mounting system of claim 1, wherein the auxiliary device is part a utility handle for a weapon or a scope ring for a weapon.

15. A mounting system for securing an auxiliary device to a weapon, comprising:

a housing having a distal end, an opposing proximal end and a longitudinally extending housing groove extending within an upper surface of the housing;

a first mounting assembly detachably secured to a first side of the housing, comprising a first back member;

an upper ledge extending outwardly from the back member;

a lower edge, separated from and located below the upper ledge; and a first mounting assembly groove formed by the separation of the upper ledge and the lower edge, the first mounting assembly groove adapted to receive a first portion of the auxiliary device securing the auxiliary device to the mounting system;

a second mounting assembly fixedly secured to a second side of the housing, the upper surface located between the first and second sides of the housing and where the first mounting assembly moveable in relation to the second mounting assembly;

a tab slidably located between the first and second mounting assemblies and within the longitudinally extending housing groove, where the slideable tab is configured to adjust placement of the auxiliary device adapting the auxiliary device to the weapon.

16. The mounting system of claim 15, wherein the first mounting assembly further comprises:

a first receiving post integrally connected to, and located below, the lower edge;

a second receiving post integrally connected to, and located below the lower edge; and a main receiving post integrally connected to, and located below, the lower edge and between the first and second receiving posts.

17. The mounting system of claim 16, wherein the second mounting assembly comprises:

a second back member;

an upper portion extends outwardly from the second back member;

a second mounting assembly groove located below the upper portion adapted to receive a second portion of the auxiliary device securing the auxiliary device to the mounting system; and a lower portion extends downward and outwardly from the second mounting assembly groove.

18. The mounting system of 17, wherein the second back member of the second mounting assembly comprises:

a main hole adapted for receiving a first threaded bolt, the first threaded bolt extends through the main hole and into the longitudinally extending housing groove; and a second hole adapted for receiving a second threaded bolt, the first threaded bolt extends through the second hole and into the longitudinally extending housing groove.

19. The mounting system of claim 18, wherein the first threaded bolt further extends through a third hole located in the housing and into the main receiving post of the first mounting assembly; wherein the first threaded bolt is adapted for adjusting the first mounting assembly to accommodate the auxiliary device to different weapons; and wherein the first threaded bolt engages with the tab.

20. The mounting assembly of claim of claim 15, wherein the tab comprises:

a horizontally elongated member having an upper surface and an opposing lower surface;

an upper surface member extending upwardly from a partial upper surface portion of the elongated member; and a lower surface member extending downwardly from a partial portion lower surface.

* * * * *